US010150638B2

(12) United States Patent
Oh

(10) Patent No.: US 10,150,638 B2
(45) Date of Patent: Dec. 11, 2018

(54) TAPE DISPENSER

(71) Applicant: Yong Chul Oh, Seoul (KR)

(72) Inventor: Yong Chul Oh, Seoul (KR)

( * ) Notice: Subject to any disclaimer, the term of this patent is extended or adjusted under 35 U.S.C. 154(b) by 143 days.

(21) Appl. No.: 15/025,676

(22) PCT Filed: Sep. 29, 2014

(86) PCT No.: PCT/KR2014/009135

§ 371 (c)(1),
(2) Date: May 25, 2016

(87) PCT Pub. No.: WO2015/047003

PCT Pub. Date: Apr. 2, 2015

(65) Prior Publication Data

US 2016/0304309 A1 Oct. 20, 2016

(30) Foreign Application Priority Data

Sep. 30, 2013 (KR) ..... 10-2013-0115839

(51) Int. Cl.
*B65H 35/00* (2006.01)
*B25G 1/06* (2006.01)

(52) U.S. Cl.
CPC ..... *B65H 35/008* (2013.01); *B65H 35/0033* (2013.01); *B25G 1/06* (2013.01)

(58) Field of Classification Search
CPC ..... B65H 35/002; B65H 35/0033; B65H 35/008; B65H 35/0026
USPC ..... 225/65, 21
See application file for complete search history.

(56) References Cited

U.S. PATENT DOCUMENTS 2,255,627 A * 9/1941 Steiner ..... B65H 35/006 225/14
2,671,271 A * 3/1954 Aldrich ..... B65H 35/0066 225/11
2,793,694 A * 5/1957 Vogt ..... B65H 35/0026 225/21
3,452,511 A * 7/1969 Hoffler ..... B65B 41/12 225/12
3,707,251 A * 12/1972 Dashnier ..... B65H 35/0006 225/21

(Continued)

FOREIGN PATENT DOCUMENTS

JP 63116469 7/1988
JP 06059356 8/1994

(Continued)

OTHER PUBLICATIONS

International Search Report—PCT/KR2014/009135 dated Feb. 3, 2015.

*Primary Examiner* — Kenneth E Peterson
(74) *Attorney, Agent, or Firm* — Cantor Colburn LLP

(57) ABSTRACT

Provided is a tape dispenser that easily cuts a tape. A tape dispenser includes a drum mounted with a tape roll, a frame supporting the drum, a guide roller rotatably disposed in the frame and guiding a tape at a front side of the drum, and a cutter blade disposed at a front end of a support of the frame and cutting the tape. Here, the cutter blade includes side ends extending in a tape extending direction from a front end on which a plurality of cutting protrusions are formed, and the front end of the cutter blade inclines with respect to the side ends.

6 Claims, 7 Drawing Sheets

(56) References Cited

U.S. PATENT DOCUMENTS

| | | | | | |
|---|---|---|---|---|---|
| 3,991,923 | A * | 11/1976 | Nishikawa | B65H 35/0026 | 225/20 |
| 4,493,446 | A * | 1/1985 | Wirth | B65H 35/0026 | 225/21 |
| 4,624,398 | A * | 11/1986 | Girardi | B65H 35/0026 | 225/21 |
| 4,979,414 | A * | 12/1990 | Caveney | B65H 35/0026 | 225/21 |
| 5,878,932 | A * | 3/1999 | Huang | B65H 35/0026 | 225/65 |
| 8,474,504 | B2 * | 7/2013 | Vulpitta | B65H 35/0033 | 156/486 |

FOREIGN PATENT DOCUMENTS

| | | |
|---|---|---|
| JP | 2008280125 | 11/2008 |
| WO | 2011101675 | 8/2011 |

* cited by examiner

TAPE DISPENSER

TECHNICAL FIELD

The following disclosure relates to a tape dispenser, and in particular, to a tape dispenser with a cutter blade which is obliquely formed.

BACKGROUND ART

As well-known, boxes that store goods are sealed through an adhesive tape and then are transported. This box sealing is being performed manually by a worker with a roller type of adhesive tape cutter.

A typical tape cutter is configured to include a main body in which a roll type of adhesive tape is rotatably coupled to a winding roll, a rotatable drum member which adheres the tape to the surface of a box when the main body moves, at least one roller member which is provided in the main body to guide withdrawal of the tape, and a fixed cutting blade which is provided so as to be exposed at the front end of the main body and cuts the tape when rotating about the drum member.

During the box packaging, when the main body moves along a cut line of a box while the front end of the tape is attached to the initial location of a cut part of the box, the drum member that rotates may move while pressurizing the adhesive tape, and simultaneously, the tape is adhered to the cut part by a pressurizing rotation force. At this point, the adhesive tape is continuously withdrawn while being rotated by a pulling force.

Thereafter, when the cut part is sealed by the tape, a worker allows the main body to be spaced from the box by a certain distance and then rotates the main body about the drum member adhered to the surface of the tape. Then, the cutting blade exposed to the front side of the main body pressurizes and cuts the surface of the tape.

However, since a worker uses the above-mentioned typical tape cutter while holding the tape cutter with his/her hand, the tape cutter may slip out of worker's hand, causing occurrence of injury. Also, when the tape is not partially adhered to the box while being withdrawn from the front end of the tape cutter, a work needs to push the tape again.

DISCLOSURE

Technical Problem

Accordingly, the present disclosure provides a tape dispenser that can easily cut a tape. The present disclosure also provides a tape dispenser that can easily hold a tape.

Technical Solution

In one general aspect, a tape dispenser includes: a drum mounted with a tape roll; a frame supporting the drum; a guide roller rotatably disposed in the frame and guiding a tape at a front side of the drum; and a cutter blade disposed at a front end of a support of the frame and cutting the tape, wherein the cutter blade may include side ends extending in a tape rewinding direction from a front end on which a plurality of cutting protrusions are formed, and the front end of the cutter blade inclines with respect to the side ends.

An angle between the side end and the front end may range from about 60 degrees to about 85 degrees.

A long side formed at one side end of the cutter blade may be longer than a short side formed at the other side end of the cutter blade, and the length of the long side of the cutter blade may be larger about 1.2 times to about 5 times than the length of the short side.

The cutter blade may be fixed to the support fixed to the frame, and the support may include a first protection protrusion parallel to a long side of the cutter blade and a second protection protrusion parallel to a short side of the cutter blade. Also, a distance between a front end of the first protection protrusion and a front end of the long side of the cutter blade may be smaller than a distance between a front end of the second protection protrusion and a front end of the short side of the cutter blade.

The tape dispenser may include a grip member having a rod-like shape and disposed inside the drum. Here, the grip member may be disposed slidably along a rail extending in a width direction of the drum.

The frame may include a support protrusion disposed under the guide roller and pressurizing the tape to the guide roller.

The frame may include two support protrusions, and the support protrusions have an arc shape.

The tape dispenser may include an auxiliary protrusion protruding from the frame under the cutter blade and making contact with the tap. Here, the auxiliary protrusion may downwardly incline with respect to the cutter blade.

An inclination angle between the auxiliary protrusion and the cutter blade may range from about 5 degrees to about 30 degrees.

The auxiliary protrusions may be formed in plurality on the frame, and the plurality of auxiliary protrusions may be disposed spaced from each other in a width direction of the frame. Also, the length of the auxiliary protrusion may gradually decrease from one side end to the other side end of the frame.

The tape dispenser may include a shock-absorbing cover formed of an elastic material and coupled to the frame. Here, the frame may include a support rib that covers a side end of the shock-absorbing cover.

Other features and aspects will be apparent from the following detailed description, the drawings, and the claims.

Advantageous Effects

According to an embodiment of the present invention, since the front end of a cutter blade on which cutting protrusions are obliquely formed, a tape can be more easily cut.

Also, since a grip is disposed movably along a rail formed in a drum, a user can selectively use the left or right hand in order to use the tape disperser.

In addition, since a support protrusion is formed and thus the tape does not adhere again to a tape roll after cutting of the tape, it is easy for a user to use the tape dispenser again.

BEST MODE

Figure 1:
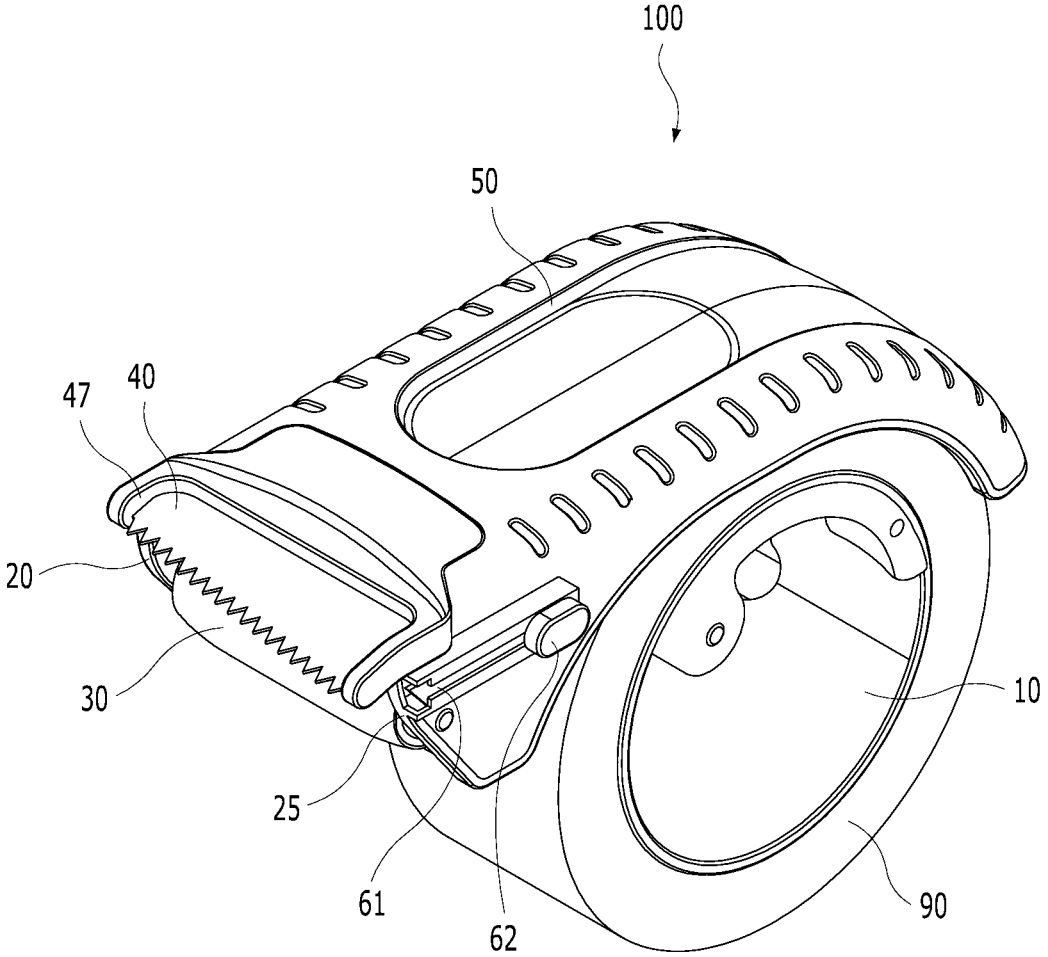
FIG. 1 is a top perspective view illustrating a tape dispenser according to a first embodiment of the present invention.

Hereinafter, exemplary embodiments of the present invention will be described in detail with reference to the accompanying drawings so that those skilled in the art can easily carry out the present invention. Since the present invention can be modified into various types and can be implemented into various embodiments, specific embodiments will be illustrated in the drawings and described in this disclosure in detail. However, the present invention is not limited to a specific implementation type, but should be construed as including all modifications, equivalents, and substitutes involved in the spirit and the technical scope of the present invention.

The terms including the ordinal numbers such as "a first/the first" and "a second/the second" may be used to describe various components, but the components will not be limited by the terms. The terms are used only in order to distinguish one component from another component.

For example, a first component may be named a second component without deviating from the scope of the present invention, and similarly, the second component may be named the first component. The term "and/or" includes a combination of a plurality of related items or any one of a plurality of related items.

Unless described otherwise, all terms used herein including technical or scientific terms may include the same meaning as those generally understood by persons skilled in the art to which the present invention belongs. Terms as defined in dictionaries generally used should be construed as including meanings which accord with the contextual meanings of related technology. Also, unless clearly defined in this disclosure, the terms should not be construed as having ideal or excessively formal meanings.

Figure 2:
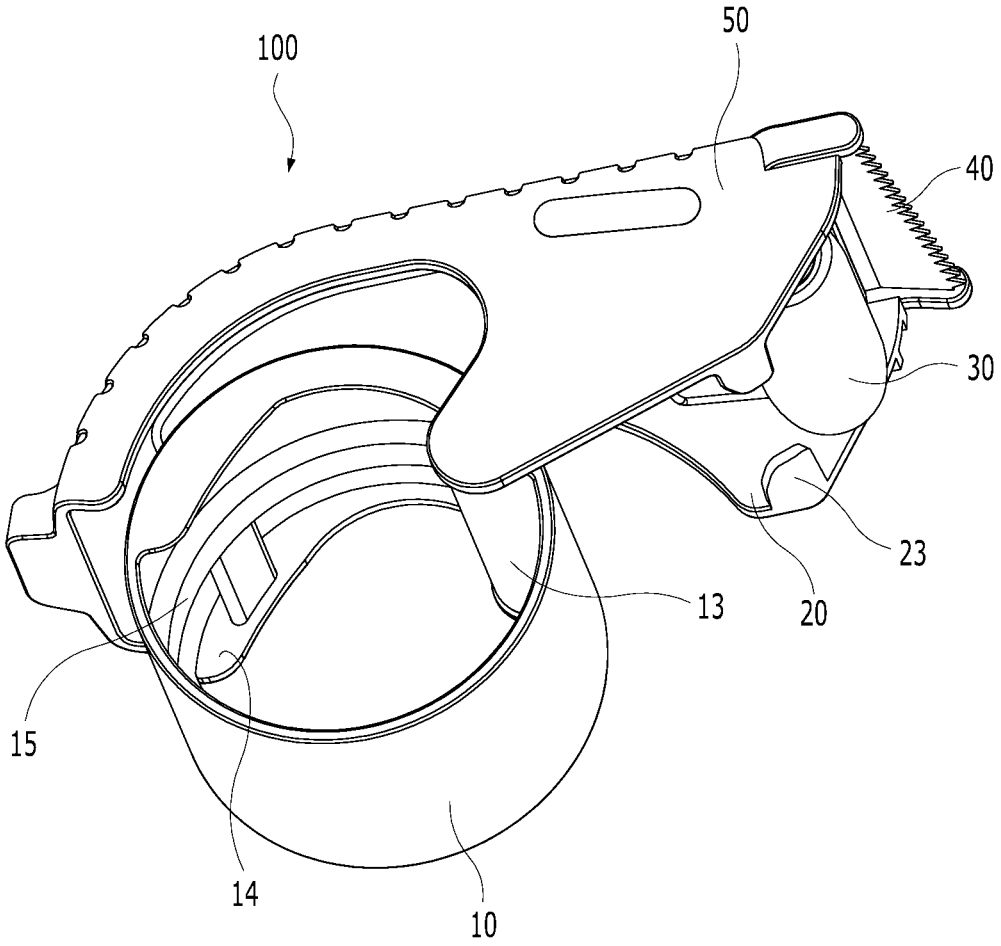
FIG. 2 is a bottom perspective view illustrating a tape dispenser according to a first embodiment of the present invention.
Figure 3:
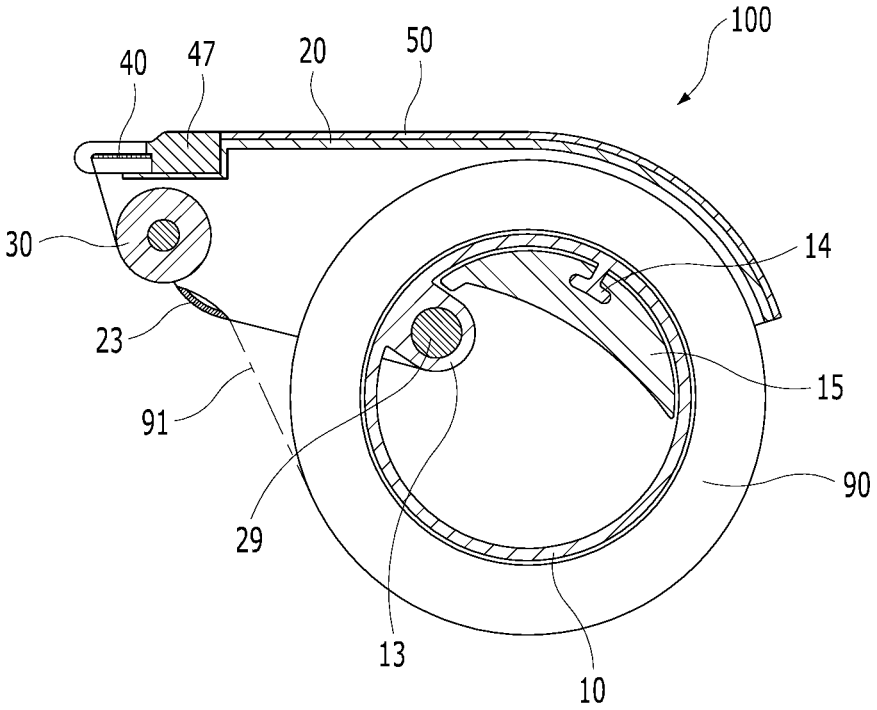
FIG. 3 is a longitudinally-sectional view illustrating a tape dispenser according to a first embodiment of the present invention.

FIG. 1 is a top perspective view illustrating a tape dispenser according to a first embodiment of the present invention. FIG. 2 is a bottom perspective view illustrating a tape dispenser according to a first embodiment of the present invention. FIG. 3 is a longitudinally-sectional view illustrating a tape dispenser according to a first embodiment of the present invention.

Referring to FIGS. 1 to 3, a tape dispenser 100 according to this embodiment may include a drum 10 mounted with a tape roll 90, a frame 20 supporting the drum 10, a guide roller 30 guiding the tape 91 at the front side of the drum 10, a cutter blade 40 cutting the tape 91, and a shock-absorbing cover 50 coupled to the frame 20.

The drum 10 may be formed into a tubular shape having a circular section, and the tape roll 90 may be mounted onto the outer circumferential surface of the drum 10. The drum 10 may be inserted into the center of the tape roll 90, and the tape roll 90 may be disposed so as to rotate about the drum 10. On the other hand, a ring part 13 may protrude from the inner side of the drum to receive a support bar 29 formed on the frame 20.

Also, a rail 14 may be formed on the inner side of the drum 10, and may extend in a width direction of the drum 10. The rail 14 may have a vertical section of substantial T-shape. Also, a grip member 15 may be slidably disposed on the rail 14. The grip member 15 may have a rod-like shape that has an outer circumferential surface of an arc shape such that a user can cover the grip member 15 with his/her fingers. The grip member 15 may have a groove 15*a* which is formed in the grip member 15 and into which the rail 14 is inserted, and thus may move in a width direction of the drum 10 along the rail 14.

When a user grips the tape dispenser 100 with his/her right hand, the grip member 15 may move right, and when a user grips the tape dispenser 100 with his/her left hand, the grip member 15 may move left, making it easier for a user to grip the tape dispenser 100.

Figure 4:
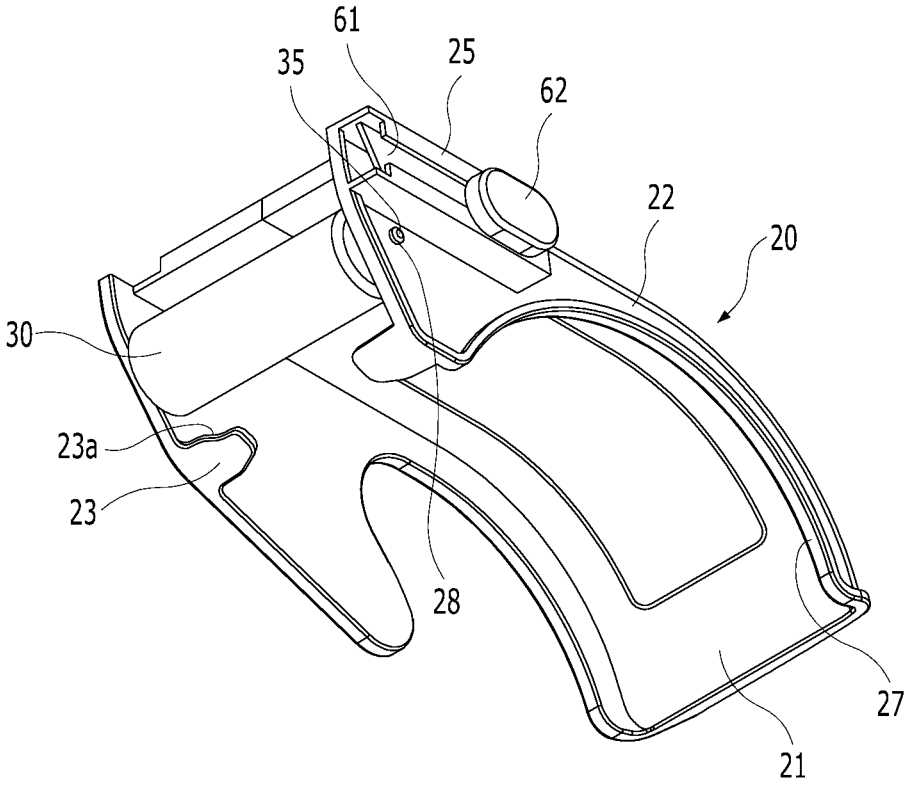
FIG. 4 is a perspective view illustrating a frame and a guide roller according to a first embodiment of the present invention.

FIG. 4 is a perspective view illustrating a frame and a guide roller according to a first embodiment of the present invention.

Referring to FIGS. 1 to 4, the frame 20 may be disposed to cover the drum 10 from the top of the drum 10. The drum 10 and the guide roller 30 may be fixedly disposed on the frame 20. The drum 10 may be fixed to the frame 20 by the support bar 29. The support bar 29 may be fixed to the frame 20, e.g., by a screw.

The frame 20 may include an upper surface portion 21 and a side surface portion 22 bent from the upper surface portion 21 and extending parallel to the side surface of the drum 10. The guide roller 30 may be rotatably disposed in the frame 20, and the frame 20 may have a hole 28 which is formed therein and into which a rotation axis 35 for supporting the guide roller 30 is inserted. The guide roller 30 may be disposed between the side surface portions 22 of the frame 20. The guide roller 30 may have a cylindrical shape.

The frame 20 may include a support protrusion 23 which supports the tape 91 separated from the tape roll 90. The support protrusion 23 may protrude from both side surface portions 22 of the frame 20 of the tape dispenser 100, respectively. The support protrusion 23 may serve to pressurize the tape 91 in a direction toward the guide roller 30 under the guide roller 30. Accordingly, the tape 91 separated from the tape roll 90 may not be again attached to the tape roll 90, and may be maintained in an easily reusable state.

The support protrusion may have a recessed portion 23*a* which is concavely dented at an upper end of the support protrusion 23. As the recessed portion 23*a* is formed, the tape 91 separated from the tape roll 90 may be easily inserted inside the support protrusion 23. The shock-absorbing cover 50 may be disposed so as to cover the frame 20, and the frame 20 may include a support rib 27 covering the lower end of the shock-absorbing cover 50.

On the other hand, the frame 20 may include a casing 25 which is formed on one side surface portion 22 of the frame 20 and in which an auxiliary blade 61 is disposed. The auxiliary blade 61 may be slidably disposed inside the casing 25. Also, a slide button 62 may be disposed on the casing 25 in order to move the auxiliary blade 61.

Figure 5:
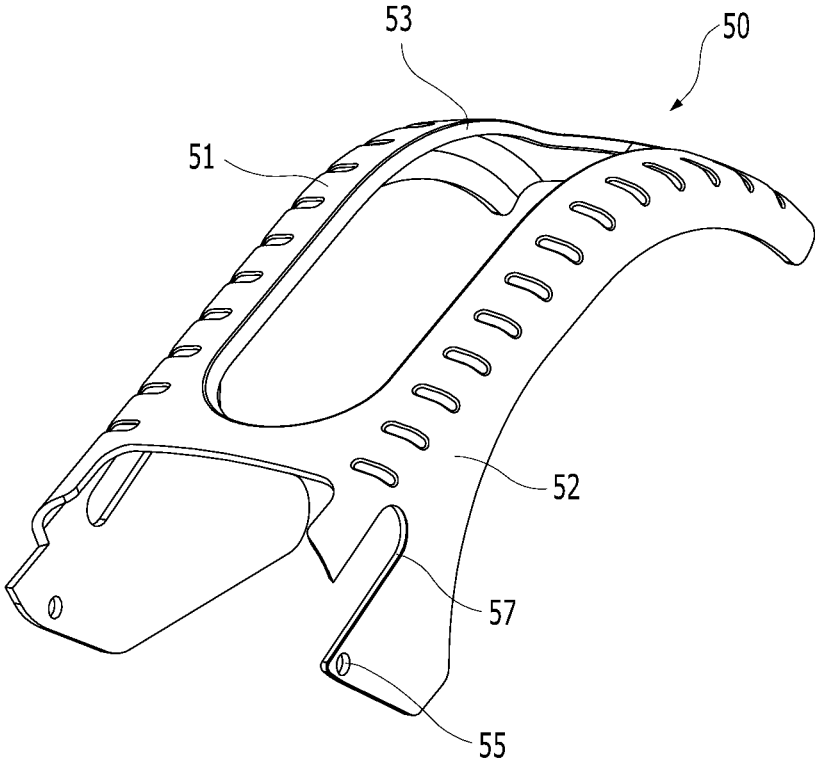
FIG. 5 is a perspective view illustrating a shock-absorbing cover according to a first embodiment of the present invention.

FIG. 5 is a perspective view illustrating a shock-absorbing cover according to a first embodiment of the present invention.

Referring to FIG. 5, a shock-absorbing cover 50 may be disposed so as to cover the upper surface portion 21 and the side surface portion 22 of the frame 20, and may be formed of polyurethane having elasticity. The shock-absorbing cover 50 may include two separable plates, and the two plates may be combined with each other at the center of the width direction of the shock-absorbing cover 50. Also, an opening 53 may be formed in the shock-absorbing cover 50 to expose the frame 20, and a dented part 57 may be formed on one end of the side surface portion of the shock-absorbing cover 50 in order to receive the casing 25.

The shock-absorbing cover 50 may include an upper surface portion 51 and a side surface portion 52 bent from the upper surface portion 51 and extending parallel to the side surface of the drum 10. Also, an opening 53 may be formed in the upper surface portion 51, and a hole 55 may be formed in the side surface portion 52 to receive the rotation axis 35 supporting the guide roller 30.

Thus, when the shock-absorbing cover 50 is mounted onto the frame 20, the tape dispenser 100 can be prevented from being damaged due to external impacts such as dropping.

Figure 6:
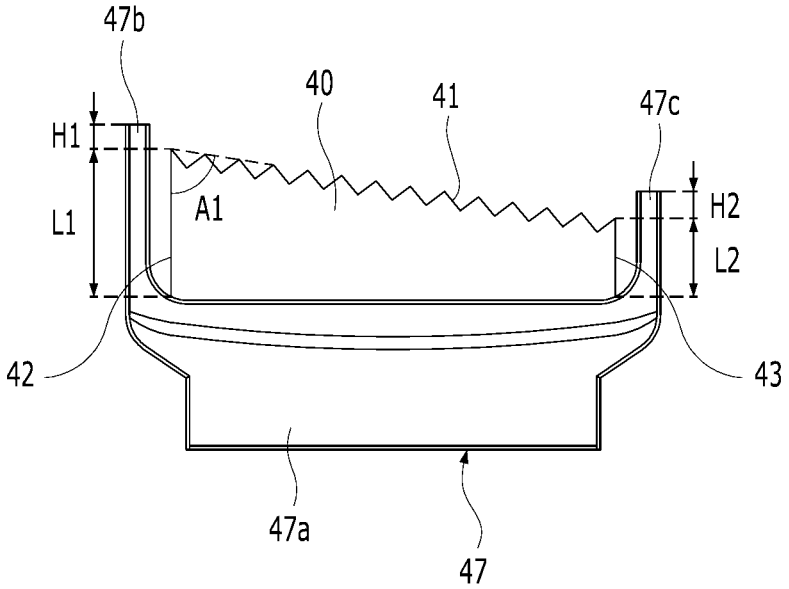
FIG. 6 is a plan view illustrating a cutter blade and a support according to a first embodiment of the present invention.

FIG. 6 is a plan view illustrating a cutter blade and a support according to a first embodiment of the present invention.

Referring to FIG. 6, the cutter blade 40 may have a plate shape, and may include a front end 41 on which a plurality of cutting protrusions are formed, and side ends 42 and 43 which extend in a tape rewinding direction from the front end 41 on which a plurality of cutting protrusions are formed. Here, the front end 41 may be formed to incline from the side end 42. The inclination angle A1 of the front end 41 with respect to the side end 42 may range from about 60 degrees to about 80 degrees.

To this end, the long side formed at one side end 42 of the cutter blade 40 may be longer than the short side formed at the other side end 43 of the cutter blade 40. The length of the long side of the cutter blade 40 may be larger about 1.2 to 5 times than the length of the short side.

The cutter blade 40 may be fixed to the frame 20 by means of a support 47. The support 47 may include a base 47*a* fixed to the frame 20, and first protection protrusion 47*b* and second protection protrusion 47*c* which protrude from the base 47*a*. The first protection protrusion 47*a* may be disposed adjacent and parallel to the long side of the cutter blade 40, and the second protection protrusion 47*c* may be disposed adjacent and parallel to the short side of the cutter blade 40. The first protection protrusion 47*b* may be located outside the long side of the cutter blade 40, and the second protection protrusion 47*c* may be located outside the short side of the cutter blade 40 to prevent a user from being injured by the cutter blade 40.

The distance H1 between the front end of the first protection protrusion 47*b* and the front end of the long side may be smaller than the distance H2 between the front end of the second protection protrusion 47*c* and the front end of the short side. The distance H1 between the front end of the first protection protrusion 47*b* and the front end of the long side may be smaller about 0.5 to about 0.9 times than the distance H2 between the front end of the second protection protrusion 47*c* and the front end of the short side.

In this embodiment, when the cutter blade 40 is formed to incline, the tape can be cut by a smaller force. Also, since the tape is cut along the inclined surface, the tape may be prevented from being irregularly cut.

Figure 7:
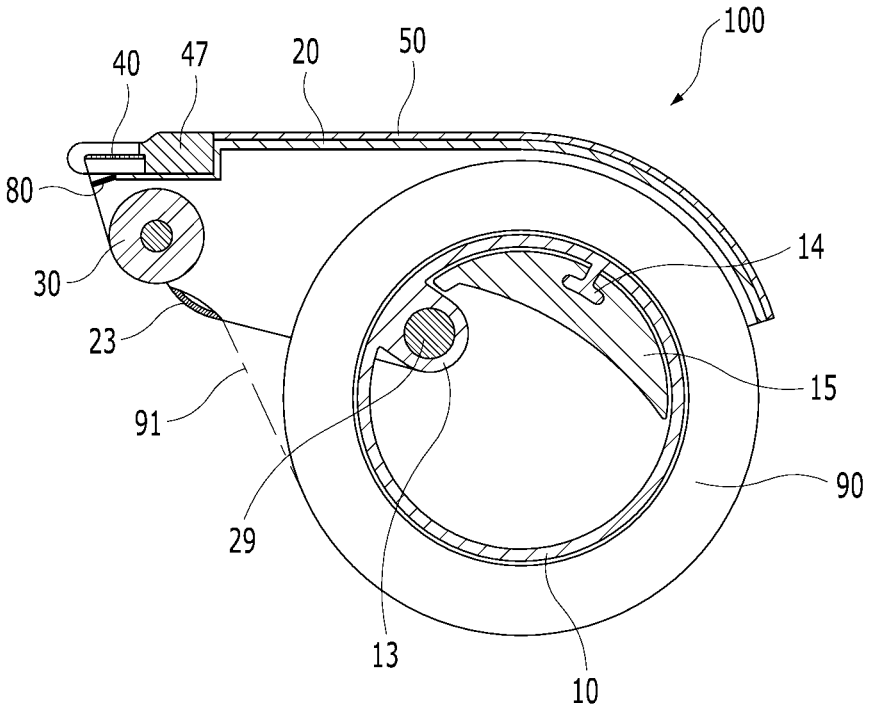
FIG. 7 is a longitudinally-sectional view illustrating a tape dispenser according to a second embodiment of the present invention.
Figure 8:
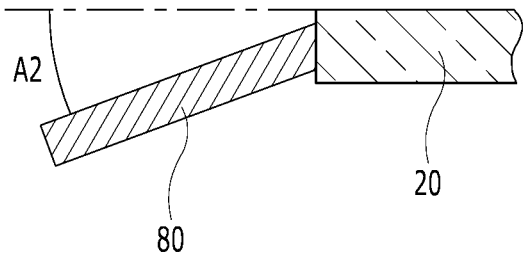
FIG. 8 is a perspective view illustrating an auxiliary protrusion according to a second embodiment of the present invention.

FIG. 7 is a longitudinally-sectional view illustrating a tape dispenser according to a second embodiment of the present invention, and FIG. 8 is a perspective view illustrating an auxiliary protrusion according to a second embodiment of the present invention.

Referring to FIGS. 7 and 8, since a tape dispenser 200 is configured to have the same structure as the tape dispenser according to the first embodiment except that an auxiliary protrusion is formed, the description of the same structure will be omitted herein.

An auxiliary protrusion 80 may protrude from the frame 20, and may make contact with the tape 91 under the cutter blade 40. The auxiliary protrusion 80 may maintain the tension of the tape 91, and may also allow the tape 91 to be scratched and cut when the auxiliary protrusion 80 is formed into a wedge shape.

A plurality of auxiliary protrusions 80 may be formed on the frame 20, and the length of the auxiliary protrusion 80 may gradually decrease from the long side to the short side of the cutter blade 40. Accordingly, an appropriate tension may be applied to the tape 90, allowing the tape 91 to be more easily cut.

The auxiliary protrusion may downwardly incline with respect to the cutter blade, and an inclination angle between the auxiliary protrusion and the cutter blade may range from about 5 degrees to about 30 degrees.

As described above, exemplary embodiments of the present invention have been disclosed in this specification and the drawings. Although specific terms are used, these are used as general meanings for easily explaining the technical details of the present invention and for helping understanding of the invention, and are not used to limit the scope of the present invention. In addition to exemplary embodiments set forth herein, it will be clear to those skilled in the art that other modifications can be implemented based on the technical spirit of the present invention.

The invention claimed is:

1. A tape dispenser comprising:

a drum mounted with a tape roll;

a grip member disposed inside the drum, wherein the grip member is disposed slidably along a rail formed inside the drum, the rail extending in a width direction of the drum, in such a manner that, when a right-handed user grips the tape dispenser, the grip member is able to move right, and when a left-handed user grips the tape dispenser, the grip member is able to move left;

a frame supporting the drum;

a shock-absorbing cover formed of an elastic material and coupled to the frame, wherein the frame comprises a support rib that covers a side end of the shock-absorbing cover;

a guide roller rotatably disposed in the frame and guiding a tape at a front side of the drum, wherein the frame comprises a support protrusion disposed under the guide roller and pressurizing the tape to the guide roller;

a cutter blade disposed at a front end of a support of the frame and cutting the tape; and an auxiliary protrusion protruding from the frame under the cutter blade and making contact with the tape, wherein the auxiliary protrusion inclines with respect to the cutter blade, wherein the cutter blade comprises side ends extending in a tape rewinding direction from a front end on which a plurality of cutting protrusions are formed, and the front end of the cutter blade inclines with respect to the side ends, and wherein the auxiliary protrusion has a length gradually decreasing from one side end to the other side end of the frame.

2. The tape dispenser of claim 1, wherein an angle between the side end and the front end ranges from 60 degrees to 85 degrees.

3. The tape dispenser of claim 1, wherein a long side formed at one side end of the cutter blade is longer than a short side formed at the other side end of the cutter blade, and the length of the long side of the cutter blade is larger 1.2 times to 5 times than the length of the short side.

4. The tape dispenser of claim 1, wherein:

the cutter blade is fixed to the support fixed to the frame;

the support comprises a first protection protrusion parallel to a long side of the cutter blade and a second protection protrusion parallel to a short side of the cutter blade; and a distance between a front end of the first protection protrusion and a front end of the long side of the cutter blade is smaller than a distance between a front end of the second protection protrusion and a front end of the short side of the cutter blade.

5. The tape dispenser of claim 1, wherein the frame comprises two support protrusions, and the support protrusions have an arc shape.

6. The tape dispenser of claim 1, wherein an inclination angle between the auxiliary protrusion and the cutter blade ranges from 5 degrees to 30 degrees.

* * * * *